US005632571A

United States Patent [19]

Mattox

[11] Patent Number: 5,632,571

[45] Date of Patent: May 27, 1997

[54] CONCRETE GEOMATTRESS

[75] Inventor: Robert M. Mattox, Fairhope, Ala.

[73] Assignee: The Tensar Corporation, Atlanta, Ga.

[21] Appl. No.: 455,684

[22] Filed: May 31, 1995

[51] Int. Cl.[6] ..... E02B 3/14

[52] U.S. Cl. ..... 405/19; 405/20

[58] Field of Search ..... 405/17, 18, 19, 405/20, 258

[56] References Cited

U.S. PATENT DOCUMENTS

| | | | |
|---|---|---|---|
| 3,699,686 | 10/1972 | De Winter | 405/19 |
| 3,874,177 | 4/1975 | De Winter | 405/19 |
| 3,922,865 | 12/1975 | Nijdam | 405/20 X |
| 4,370,075 | 1/1983 | Scales | 405/20 |
| 4,374,798 | 2/1983 | Mercer | 264/288.8 |
| 4,375,928 | 3/1983 | Crow et al. | 405/20 |
| 4,394,924 | 7/1983 | Zaccheroni | 220/486 |
| 4,417,828 | 11/1983 | De Winter | 405/17 |
| 4,421,439 | 12/1983 | Ter Burg et al. | 405/258 |
| 4,449,847 | 5/1984 | Scales et al. | 405/19 |
| 4,499,664 | 2/1985 | Scales | 29/714 |
| 4,502,815 | 3/1985 | Scales et al. | 405/17 |
| 4,530,622 | 7/1985 | Mercer | 405/258 |
| 4,564,311 | 1/1986 | Scales | 405/20 |
| 4,592,675 | 6/1986 | Scales et al. | 405/19 |
| 4,726,708 | 2/1988 | Papetti | 405/19 |
| 4,743,486 | 5/1988 | Mercer et al. | 428/134 |
| 4,896,993 | 1/1990 | Bohnhoff | 404/33 |
| 5,108,222 | 4/1992 | Jansson et al. | 405/20 |
| 5,507,594 | 4/1966 | Speicher | 405/19 X |

FOREIGN PATENT DOCUMENTS

| | | | |
|---|---|---|---|
| 608036 | 7/1994 | European Pat. Off. | 405/19 |
| 89611 | 7/1981 | Japan | 405/20 |
| 98040 | 4/1961 | Netherlands | 405/19 |
| 1361233 | 12/1987 | U.S.S.R. | 405/19 |

OTHER PUBLICATIONS

"Tensar Gabions & Mattresses" Brochure (undated).
"Tensar Gabion Installation Instructions" IB/TG/4.88, Brochure.
"Tensar Goecell Installation Procedure" IB/Geocell/10.88, Information Bulletin.
"Tensar Geocell Mattress" Brochure (undated).
Tensar "A Guide to Products and Their Applications" (undated).
Tensar "Environmental Engineering Alternatives" (undated).
Tensar "Slope Reinforcement" Brochure (undated).

*Primary Examiner*—David J. Bagnell
*Attorney, Agent, or Firm*—Jacobson, Price, Holman & Stern, PLLC

[57] ABSTRACT

Multiple sections of grid-like sheet material extend centrally through a thickness of a plurality of staggered rows of concrete panels to form a geomattress of unlimited dimensions. The sheet material preferably includes a plurality of parallel strands and perpendicular, intersecting bars. At least one bar extends within each concrete panel in a direction parallel to a longitudinal axis of the concrete panel to add strength to the formed geomattress and aid in lifting of the geomattress by the sheet material. The geomattress is formed by placing a section of sheet material above bottom mold halves filled with concrete and then filling top mold halves positioned above the sheet material with concrete. Gaps formed between adjacent rows of staggered panels and tapered sidewalls of the panels allow bending of the geomattress to aid in lifting the geomattress and to conform to a limited extent to the contour of the area onto which the geomattress is placed.

35 Claims, 9 Drawing Sheets

CONCRETE GEOMATTRESS

FIELD OF THE INVENTION

This invention relates to a concrete geomattress and its method of manufacture. The geomattress may be used to cover a dredge spoil dumpsite, for example, and will adapt itself to the terrain of the dumpsite.

BACKGROUND OF THE INVENTION

Harbors throughout the United States require periodic dredging to maintain sufficient draft depth for shipping. The dredge spoil produced by this operation is loaded into bottom dump barges and transported out to sea to underwater dredge disposal sites which have been identified by the U.S. Army Corps of Engineers.

At the disposal site the dredge spoil material is simply dumped from the barge and allowed to settle to the bottom of the sea at a depth ranging from 150 to 200 feet. This procedure creates large domes of dredge spoil material which range from 1000 to 2300 feet in diameter. The dredge spoil material oftentimes includes contaminated material which is potentially harmful to the environment. A solution is presently being sought to develop ways of capping these domes to prevent migration of the contaminated material to the surrounding ocean beds and water.

A proposed solution to this problem is the use of a concrete mass to cap the domes of contaminated material.

There is currently a concrete revetment system on the market, sold under the name of ARMORFLEX and disclosed in U.S. Pat. No. 4,370,075. In this system, a plurality of individual concrete blocks are cast with horizontally and vertically oriented holes. After the blocks have cured, they are then moved to an assembly area where they are positioned into their final configuration by hand. This is then followed by the threading of steel cables through the horizontally oriented, pre-formed holes in each concrete block to tie the entire panel together. The panels are then lifted from both ends of the steel cables by a sling system and placed in a position of use. The vertically oriented holes that are cast into the concrete blocks are for soil filling to allow for revegetation through the vertically oriented holes.

The two cables passing through the horizontally oriented pre-formed holes allow movement of each block unit. Repeated abrasion of the cables under wave action can cause eventual failure of the cable system. Should this occur the entire panel configuration would be in jeopardy. To prevent this occurring, the individual concrete blocks are designed based upon the expected wave forces. The main component of this design is the weight and size of each individual concrete block.

In another system, sold under the name ARMORFORM and disclosed in U.S. Pat. Nos. 4,449,847 and 4,502,815, a high strength fabric bag system is pumped full of concrete grout after the bag has been placed in its final position of use. This system is limited to revetment applications and cannot be economically placed in deep water.

Each of these systems has one thing in common, that is, its size is relatively small and placement is accomplished by either installation in place or by lifting small pre-assembled units. The size of these known concrete structures is on the order of twenty feet long by six-to-ten feet wide. Such concrete structures simply cannot accomplish the goal of efficiently capping the domes of contaminated dredge material.

SUMMARY OF THE INVENTION

Accordingly, it is a primary object of the present invention to produce a concrete mattress made from a plurality of concrete panels interconnected by a sheet of grid-like material which can provide coverage of a broad area, limited only by the lifting capacity of a boom to move the concrete mattress to the site of application. For example, it is envisioned as being within the scope of the present invention that a concrete mattress could be used for capping of offshore dredge disposal sites.

This object is achieved according to the instant invention by providing a plurality of spaced concrete panels interconnected by a cast-in-place grid-like sheet of material extending centrally through each panel to form a "geomattress". Preferably, the grid-like sheet material is an integral, uniaxially stretched ("UX"), polymeric grid comprising a plurality of parallel strands and perpendicular, intersecting bars. At least one bar is preferably captured in each panel and extends parallel to a longitudinal axis of the panel.

A preferred form of grid-like sheet material to interconnect the concrete panels according to this invention, known as an integral geogrid, is commercially available from The Tensar Corporation of Atlanta, Ga. ("Tensar") and is made by the process disclosed in U.S. Pat. No. 4,374,798 ("the '798 patent"), the subject matter of which is incorporated herein in its entirety by reference.

As disclosed in the '798 patent, a high strength grid may be formed by stretching an apertured plastic sheet material. Utilizing the uniaxial techniques, a multiplicity of molecularly-oriented elongated strands and transversely extending bars which are substantially unoriented or less-oriented than the strands are formed in a sheet of high density polyethylene, although other polymer materials may be used in lieu thereof. The strands and bars together define a multiplicity of grid openings. With biaxial stretching, the bars are also formed into oriented strands.

As indicated, the preferred grid-like sheet material is a uniaxially-oriented geogrid materials as disclosed in the '798 patent. However, biaxial geogrids or grid materials that have been made by different techniques such as woven, knitted or netted grid materials formed of various polymers including the polyolefins, polyamides, polyesters and the like or fiberglass, may be used. In fact, any grid-like sheet materials, including steel (welded wire) grids capable of being secured to concrete panels of the instant invention in the manner disclosed herein are suitable. Such materials are referred to herein and in the appended claims as "grid-like sheets of material". The only limitations on the selected grid-like sheet of material is that it is critical that the material allow bending along gaps formed between adjacent rows of concrete panels and the material must have sufficient strength to permit the geomattress to be lifted from one end with the grid-like sheet material supporting the weight of a plurality of concrete panels attached thereto.

Thus, while reference is made throughout to the preferred form of the interconnecting sheet material as "grid-like", it should be understood that the sheet material may have solid portions, particularly in the gap intermediate the concrete panels in the geomattress, or the sheet materials may be woven or substantially imperforate in the broadcast sense of this invention so long as the concrete in the individual panels will bond or lock to the sheet material with sufficient engagement to support the weight of the panels when used in the manner described hereafter for capping a dredge spoil dumpsite or the like. The particular advantage of using uniaxial geogrids as the interconnecting sheet materials according to the preferred embodiments of this invention resides in the ability of the cast concrete to strike through the openings of the grid and be anchored by the thickened bars to lock the grid to the concrete panels, as well as the high strength of the uniaxially oriented strands interconnecting the bars, and, thus, the panels.

The geomattress of the present invention is formed by placing sections of grid-like sheet material, preferably UX geogrid, across a plurality of spaced, staggered forms in which the bottom portion of concrete panels has been cast. Top forms are then positioned above the geogrid and the upper portions of the panels are cast with the geogrid captured centrally in each panel and extending from panel to panel to form the geomattress with the longitudinal axis of the panels extending parallel to the bars, and at least one bar encased in each panel.

A gap extending laterally and perpendicular to a longitudinal axis of the geomattress is formed between adjacent rows of panels. The geomattress is bendable along this gap.

A typical geomattress alignment incorporating the teachings of the present invention would include 6 inch thick concrete panels with dimensions of approximately 30 inches by approximately 52 inches. While any UX geogrid could be used for the concrete geomattress, a desired geometry of panels is preferably predicated on the use of UX HT series geogrids, available from Tensar. Alternate rows of panels are offset by one half (50%) panel length in order to interlock a plurality of sections of geogrid of the mattress together into a single articulating system.

Since the dredge disposal sites involve large areas and water depths ranging from 150 to 200 feet, large mattress area gives an installation advantage. Therefore, one mattress geometry envisioned depicts maximum lengths predicated on the strength of UX1700HT geogrid available from Tensar, for example. A single lift assembly of a maximum weight, for a 43.8 foot wide mattress, is 91.2 tons while the total weight for a double lift system having an interconnecting section of geogrid would be 185.7 tons. A geomattress according to the instant inventive concepts can be cast for any width, however, a 10 concrete panel width configuration of 43.8 feet is predicated on the use of some of the largest cranes currently available in the industry.

A smaller concrete geomattress is envisioned using a 4 inch thick concrete panel with plan dimensions of each panel being 8½ inches by 51.6 inches. For a single lift assembly, the maximum length will be 140 feet while a double lift mattress having an interconnecting section of geogrid could go to 284 feet. This configuration requires tremendous boom length for lifting.

In a double lift sequence, a terminal end of one half section of the geomattress is first connected to a spreader bar and picked up out of the casting bed. After lifting the first half section of the geomattress it is then laid back down on top of the other half section of the geomattress still on the casting bed. At this point, the second half section of the mattress is connected to a spreader bar and both half sections of the geomattress are lifted for positioning on a barge or on other transport equipment.

Accordingly, the geomattress of the present invention is envisioned as being used for capping of offshore dredge spoil material and other applications such as in revetments, boat launching ramps, etc. The geomattress is bendable between adjacent rows of concrete panels to aid in lifting and to adapt its configuration to conform to a limited extent to the terrain of its intended use.

Thus, it is an object of the present invention to produce a concrete geomattress using UX geogrid extending centrally through a plurality of concrete panels with at least one bar of the geogrid extending parallel to a longitudinal axis of the concrete panel and within the concrete panel.

It is another object of the present invention to manufacture a concrete geomattress using UX geogrid material passing centrally through concrete panels with the thus formed concrete geomattress being foldable upon itself along a length of the UX geogrid.

It is still yet another object of the present invention to produce a concrete geomattress by pouring concrete into a plurality of staggered bottom mold halves, laying a section of UX geogrid across the bottom mold halves, placing an upper mold half between adjacent bottom mold halves and pouring concrete into the top mold halves to encase the UX geogrid in the middle of panels formed between the upper and lower mold halves.

These and other objects of the invention, as well as many of the intended advantages thereof, will become more readily apparent when reference is made to the following description taken in conjunction with the accompanying drawings.

DETAILED DESCRIPTION OF THE PREFERRED EMBODIMENT

Figure 1:
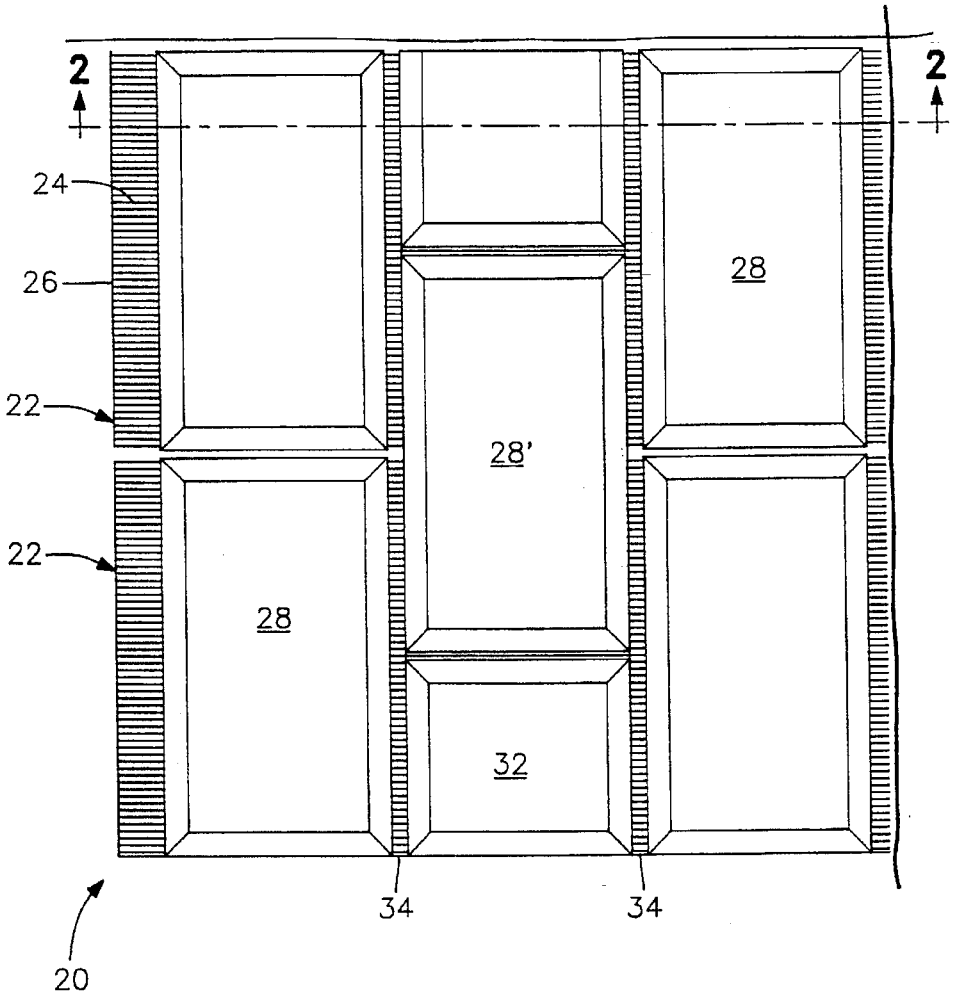
FIG. 1 is a plan view of a plurality of concrete panels secured to a layer of at least two sections of uniaxial geogrid.

In describing a preferred embodiment of the invention illustrated in the drawings, specific terminology will be resorted to for the sake of clarity. However, the invention is not intended to be limited to the specific terms so selected, and it is to be understood that each specific term includes all technical equivalents which operate in a similar manner to accomplish a similar purpose.

Figure 2:
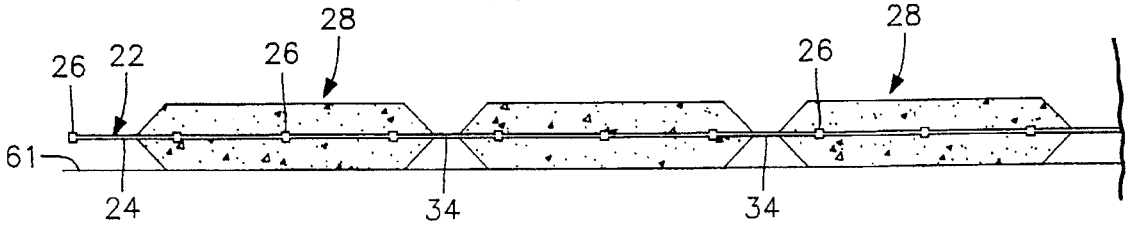
FIG. 2 is a cross-sectional view taken along line 2—2 of FIG. 1 and illustrating three concrete panels interconnected by a section of uniaxial geogrid.
Figure 3:
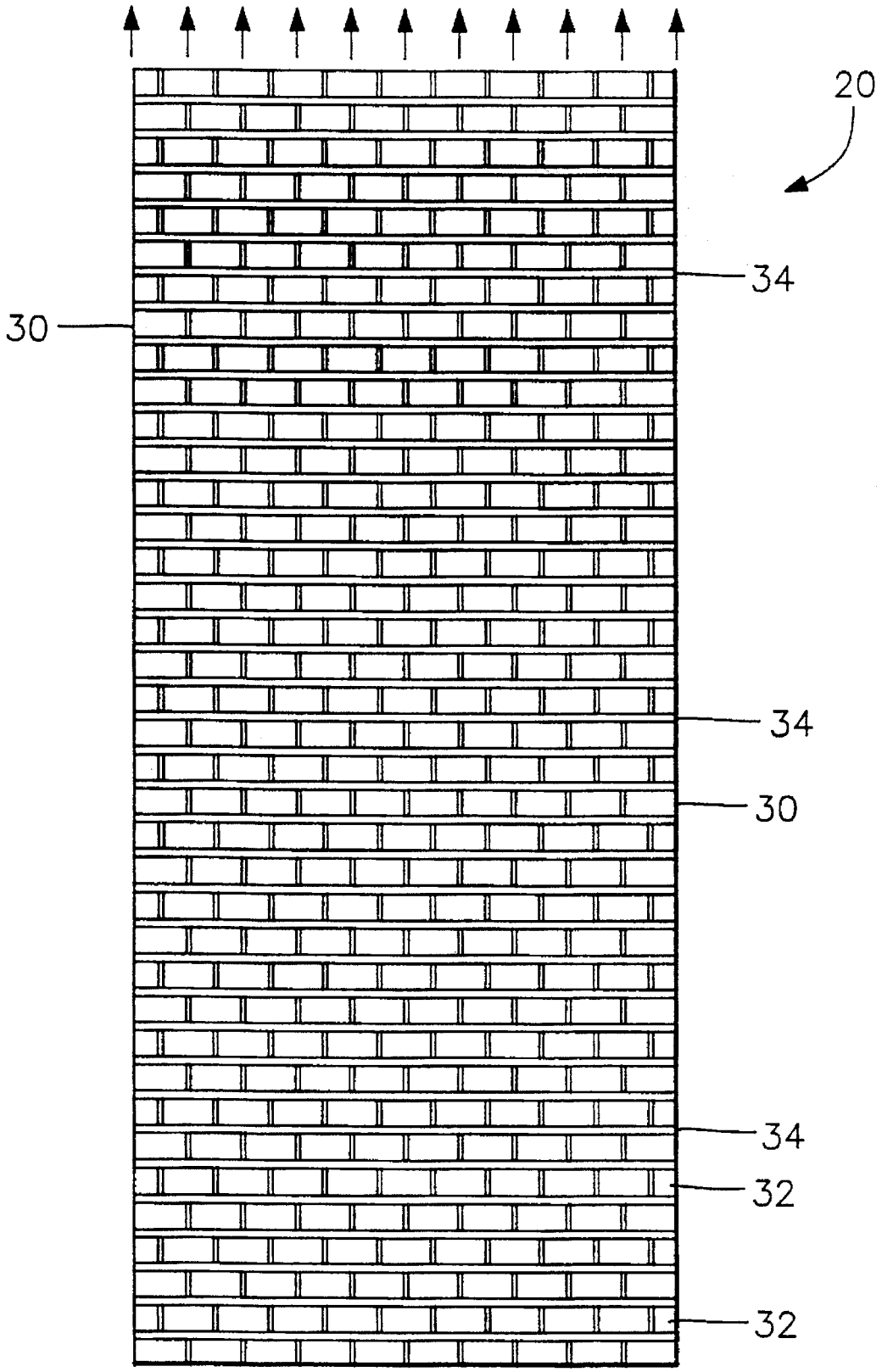
FIG. 3 is a plan view of a complete concrete geomattress according to the present invention with the individual concrete panels oriented at 90° with respect to the orientation shown in FIG. 1.

With reference to the drawings, in general, and to FIGS. 1 through 3, in particular, a concrete geomattress embodying the teachings of the subject invention is generally designated as 20. With reference to its orientation in FIG. 1, the geomattress may include a plurality of uniaxial (UX) geogrid sections 22 made in accordance with the teachings of the '798 patent.

As shown in FIGS. 1 and 2, each section 22 of UX geogrid includes a plurality of parallel strands 24 interconnected by parallel bars 26, extending perpendicular to strands 24. The bars 26 are unoriented or less oriented and, thus, thicker than the strands 24. It is noted that a longitudinal axis of panels 28 extends parallel to bars 26. In addition, at least one bar 26 is preferably encased in each panel 28, three such bars 26 being cast in each panel 28 shown in FIG. 2.

A plurality of rows of concrete panels 28 extend laterally across a formed geomattress as shown in FIG. 3. The panels in juxtaposed rows are staggered or offset by 50% so that some of the panels (see, e.g., panel 28' in FIG. 1) interconnect adjacent sections of geogrid 22. By using this arrangement the entire geomattress unit formed of a plurality of sections of geogrid material is tied together by concrete panels. Side edges 30 of the geomattress may be finished with half panels 32 as seen in FIGS. 1 and 3.

It is envisioned as being within the scope of the present invention that some or all of the concrete panels could be positioned and dimensioned to extend across the edges of the adjacent sections of geogrid so as to tie together the adjacent sections of geogrid. The spacing between adjacent concrete panels could be determined based upon the dimensions of the geogrid so as to uniformally position the concrete panels, even possibly in non-staggered rows.

Between each row of panels is a gap 34 extending laterally across the geomattress 20. The gap 34 allows a bending of the geomattress to allow the geomattress to assume a non-planar condition in use. When the gap between adjacent rows of panels is large enough, the geomattress may be folded upon itself, as will be explained hereafter with respect to the double lift sequence shown in FIGS. 17 and 18.

It is also contemplated as being within the scope of the present invention for adjacent sections of geogrid to extend perpendicular to each other in a "checkerboard" pattern. It is probable in this embodiment that a biaxial geogrid would be used. Strands of geogrid between adjacent sections of geogrid would therefore allow bending in two perpendicular planes.

In the embodiment of FIGS. 1–3, each panel 28 may have a thickness of six inches, a width of 29.5 inches and a height of 51.6 inches. With such dimensions, each panel 28 weighs approximately 675 pounds. A typical geomattress 20 as seen in FIG. 3 including panels 28 such as shown in FIGS. 1 and 2 would have a width of approximately 44 feet and a length of approximately 71 feet for a total weight of 91.2 tons. The length and the weight of the geomattress may be doubled in a double lift embodiment.

Figure 4:
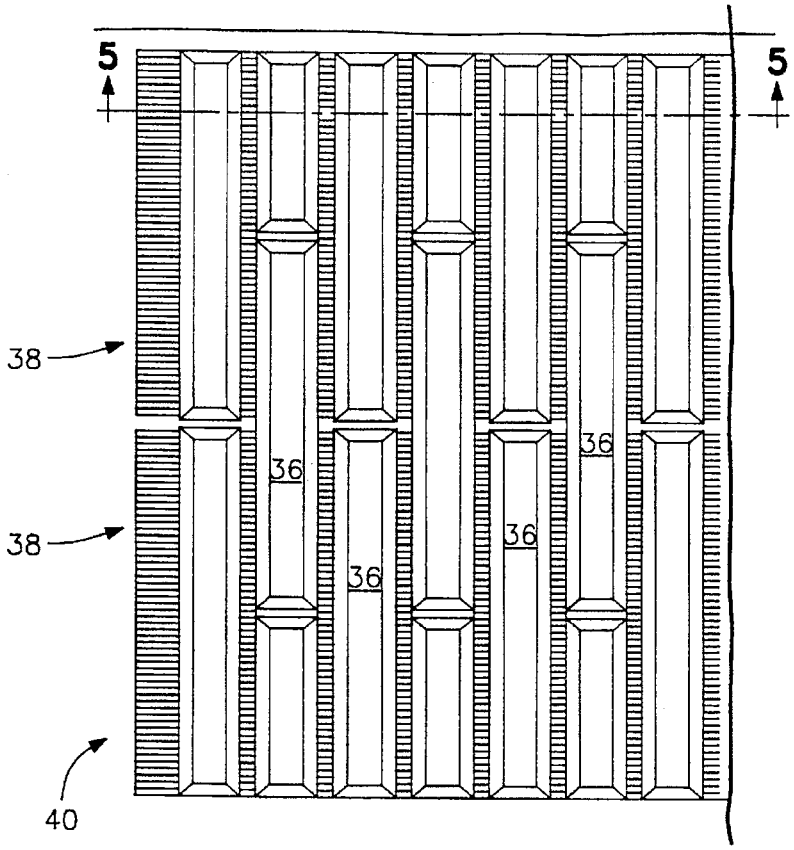
FIG. 4 is a plan view of a plurality of elongated concrete panels secured to a layer of at least two sections of uniaxial geogrid.
Figure 5:
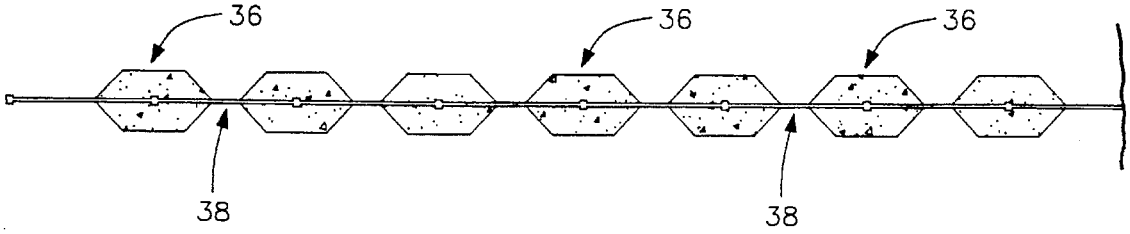
FIG. 5 is a cross-sectional view taken along line 5—5 of FIG. 4.

An alternate geometry is shown in the embodiment of FIG. 4 as comprising 4 inch thick concrete panels 36 extending across adjacent sections of UX geogrid 38 to form a geomattress 40. Each panel in this configuration is approximately 9 inches wide and approximately 52 inches long, weighing approximately 114 pounds.

Figure 8:
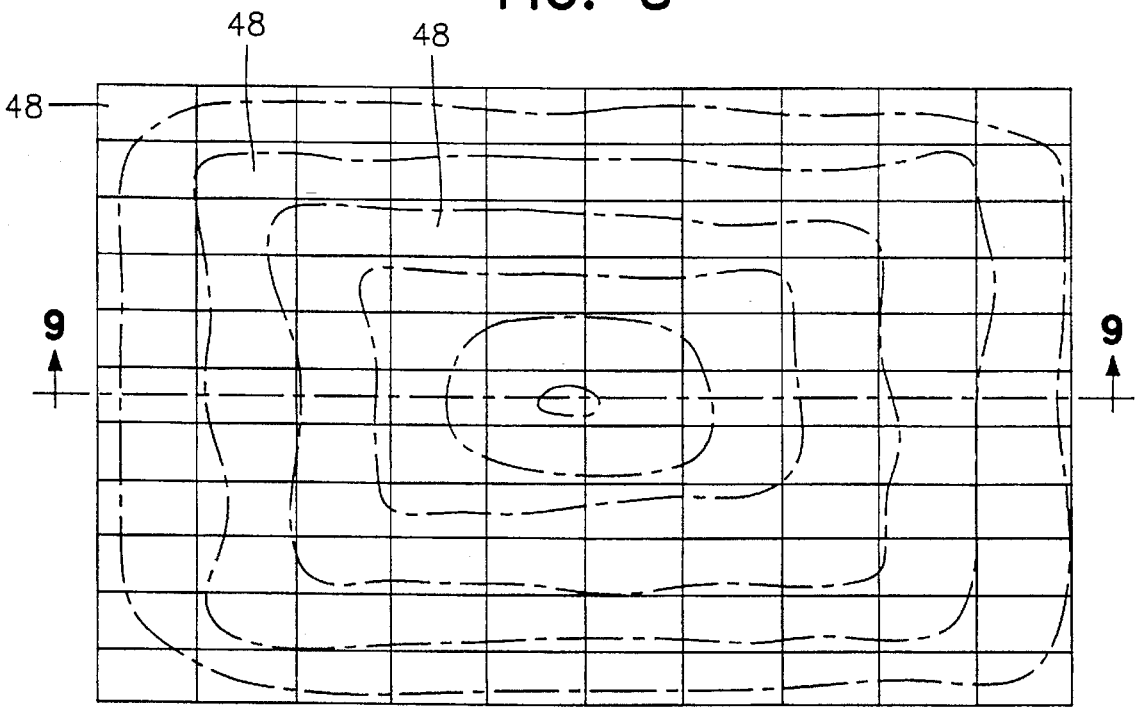
FIG. 8 is a schematic plan view of the dredge disposal site shown in FIG. 6, covered by a plurality of concrete geomattress units formed in accordance with the principles of the present invention.
Figure 9:
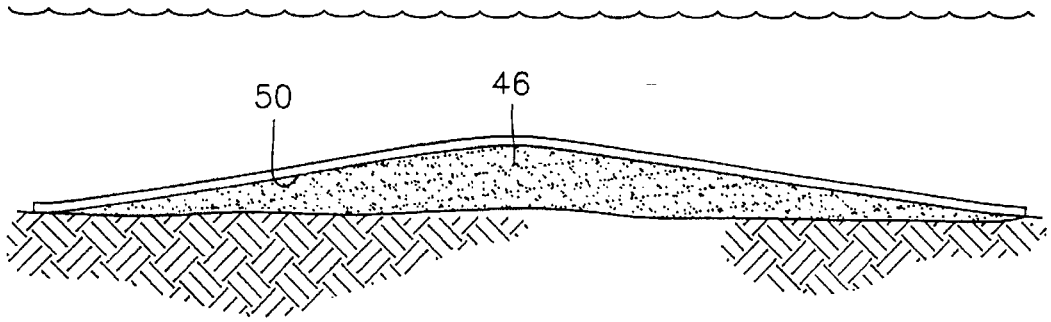
FIG. 9 is a cross-sectional view taken along line 9—9 of FIG. 8.

The width of the concrete panels are site and application specific. FIG. 1 depicts a panel width that may be used for dredge spoil capping as shown in FIGS. 8 and 9. The panel presented in FIG. 4 has a width that may be used for a boat ramp or for a ditch liner application. The width and thickness of each concrete panel are predicated on the wave energy which the concrete geomattress would have to withstand and therefore these dimensions can vary. The length of each panel can vary and may be designed to accommodate the commercially available grid-like sheets of material used to support and interconnect the panels in the geomattress.

Figure 6:
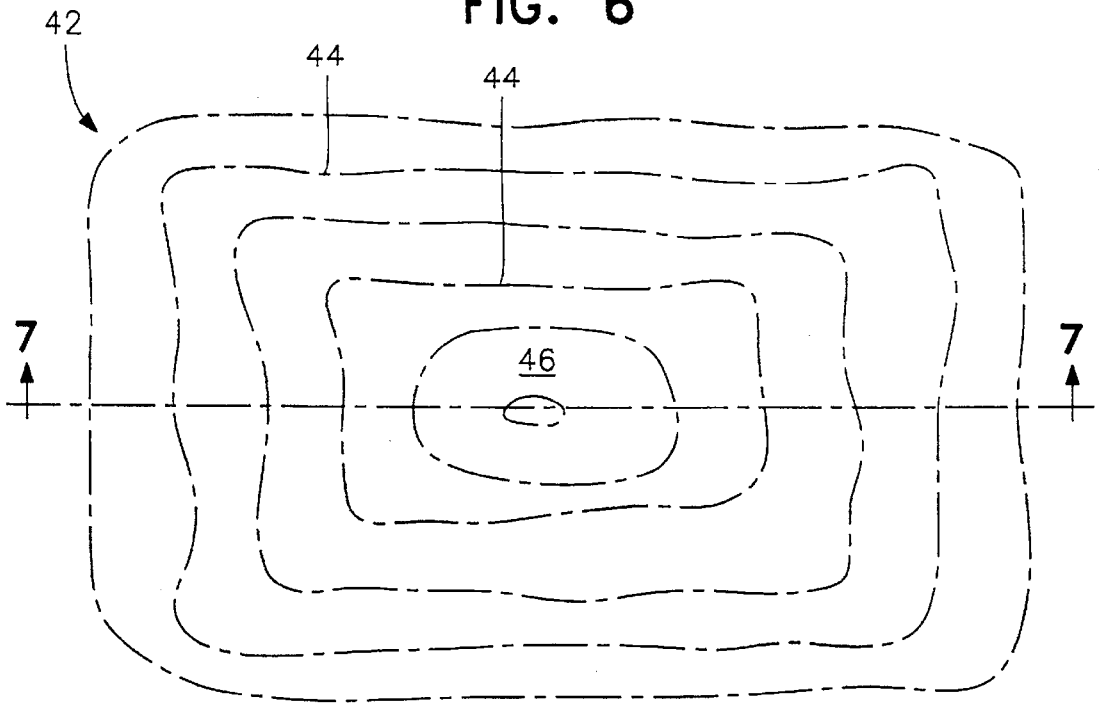
FIG. 6 is a schematic plan view of a typical offshore dredge spoil underwater disposal site.
Figure 7:
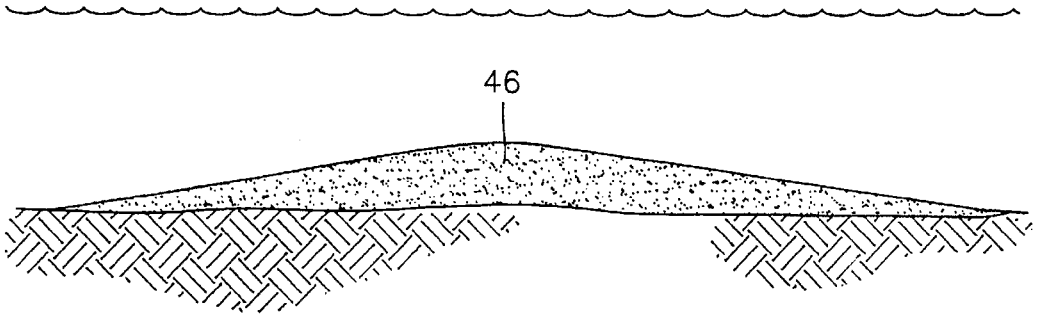
FIG. 7 is a cross-sectional view taken along line 7—7 of FIG. 6.

FIGS. 6 and 7 schematically illustrate a typical plan and cross-sectional view, respectively, of an underwater dredge spoil disposal site 42. The plan view shows the contours 44 of a rectangular shaped mound of dredge spoil while the cross-sectional view depicts a section cut through the center 46 of the dredge spoil. The shape of the dredge spoil dump site may vary from rectangular to circular, to extremely erratic depending on the methods used to dump the material and the prevailing currents at the dump site.

FIGS. 8 and 9 show how concrete geomattress units 48 may be placed to cover the dredge spoil. Each of the rectangles shown in the plan view represent a single concrete geomattress unit 48 having dimensions of approximately 44 feet by 71 feet. Obviously, dimensions may vary depending on the site conditions and available lifting equipment capacity.

Each concrete geomattress unit 48 may be laid over a geotextile 50 which functions as a filter to prevent the loss of dredge spoil through the openings between the strands of the uniaxial geogrid located in the gaps between adjacent concrete panels. The geotextile may be positioned in situ above a dump site by a separate operation in a limited water depth environment or for deep water applications, may be attached to the bottom of the concrete geomattress during the concrete casting process or glued to the bottom of the geomattress with a spray adhesive after formation of a geomattress. The installation, therefore, provides a "blanket" effect over the entire dredge spoil area, thus preventing migration of the spoil due to water currents. The gaps formed by the geogrid between adjacent concrete panels permits the geomattress units to flex and assume to a limited extent the contour of the material onto which they are placed. A preferred geotextile to be used is a non-woven geotextile which allows elongation of up to between 500 to 700% during stretching which will allow the geotextile to bend with any bending of the geomattress.

Figure 10:
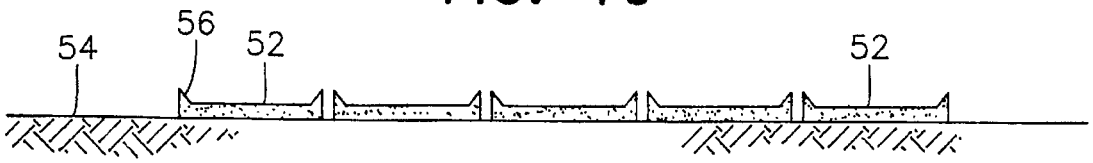
FIGS. 10 through 16 illustrate a preferred method of making a concrete geomattress and lifting the concrete geomattress from one end.

In FIGS. 10 through 16, a preferred method of making and lifting a geomattress according to this invention is shown. In FIG. 10, a plurality of bottom mold forms 52 are positioned on a flat surface 54. In FIG. 10, the bottom mold forms are shown in cross-section, it being understood that the tapered side-walls 56 of the bottom mold forms extend about the inner periphery of the mold so as to form a rectangular shaped panel having tapered sidewalls, as shown in FIGS. 1 and 4. The tapered sidewalls of the formed panel allow bending between adjacent rows of concrete panels. Although not seen in the cross-sectional view, alternate rows of mold forms are longitudinally staggered to produce a geomattress as seen, for example, in FIGS. 1 and 4.

Figure 11:
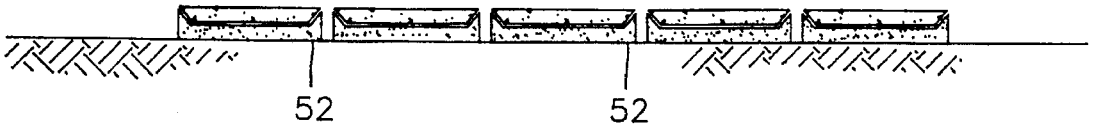
Figure 12:
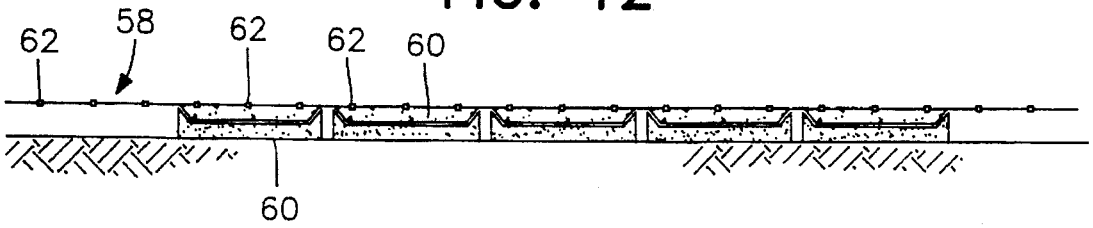

To form the lower half of the panels, concrete 60 is poured into the bottom mold forms 52 as shown in FIG. 11. Optionally, lengths of geotextile may be placed in the bottom mold forms prior to pouring of concrete to cast the geotextile into the bottom surface of the to be formed panels as shown in dotted lines at 61 in FIG. 2. While the concrete is still wet, sections of grid-like sheets of material 58, preferably uniaxial geogrid, are positioned across a series of bottom mold forms 52.

It is important, in a preferred embodiment of the invention, to have the bars 62 of the geogrid 58 extend parallel to the longitudinal axis of the concrete panels to be formed. This provides increased strength when lifting the completed geomattress from one or both ends by terminal portions of the sections of geogrid which extend beyond the ends of the formed geomattress.

Figure 13:
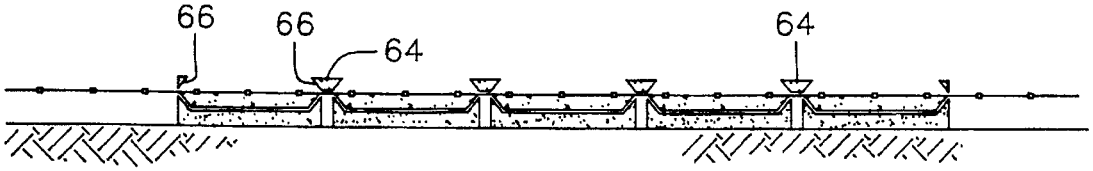
Figure 14:
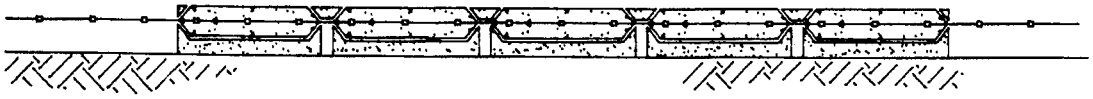
Figure 15:
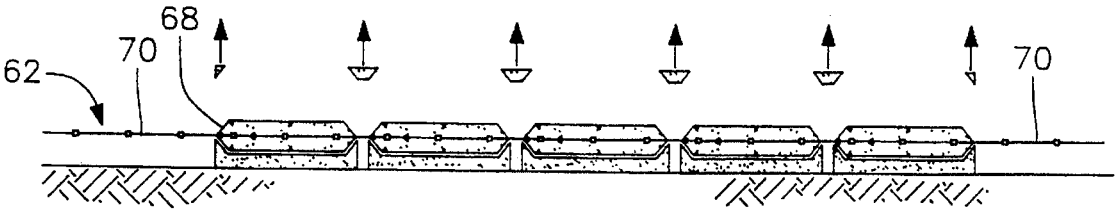
Figure 16:
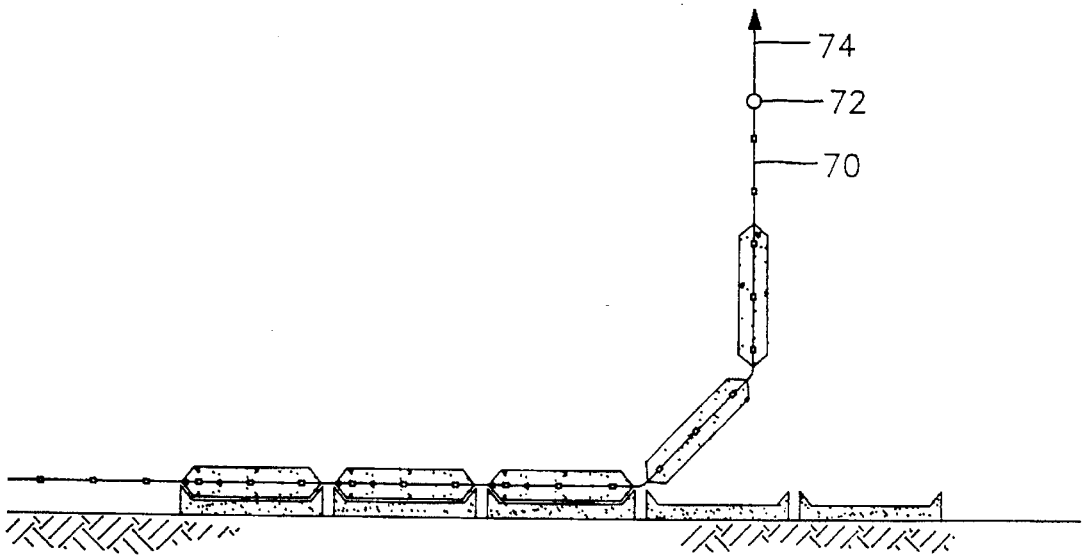

Upper mold forms 64, shown in cross-section in FIGS. 13 through 15 as having a trapezoid shape, are positioned between two adjacent bottom mold forms 52. The inclined surfaces 66 of the mold forms 64 form tapered exterior walls 68 when concrete is poured on top of the sections of geogrid 62 as shown in FIG. 14. The tapered exterior walls allow bending between adjacent panels for lifting purposes.

When the concrete has hardened, the geogrid 62 is embedded in the center of the formed concrete panels. The upper mold forms 64 are then removed as shown in FIG. 15.

A terminal portion 70 of geogrid 62 is then connected to a spreader bar 72, preferably by a Bodkin connection, as described in U.S. Pat. No. 4,530,622 to Mercer, herein incorporated in its entirety by reference, or other connection arrangement so as to lift the formed geomattress in the direction of arrow 74. The formed geomattress is thereby moved to a position of use or to a vehicle for transport.

As shown in FIGS. 1 through 5, the lifting direction of the geomattresses 20, 40 is preferably perpendicular to the extension of the bars embedded in the panels 28, 36 if the grid-like sheets of material are UX geogrids. This direction of lifting takes advantage of the maximum available strength of the geogrid entrapped in the concrete panels.

Figure 17:
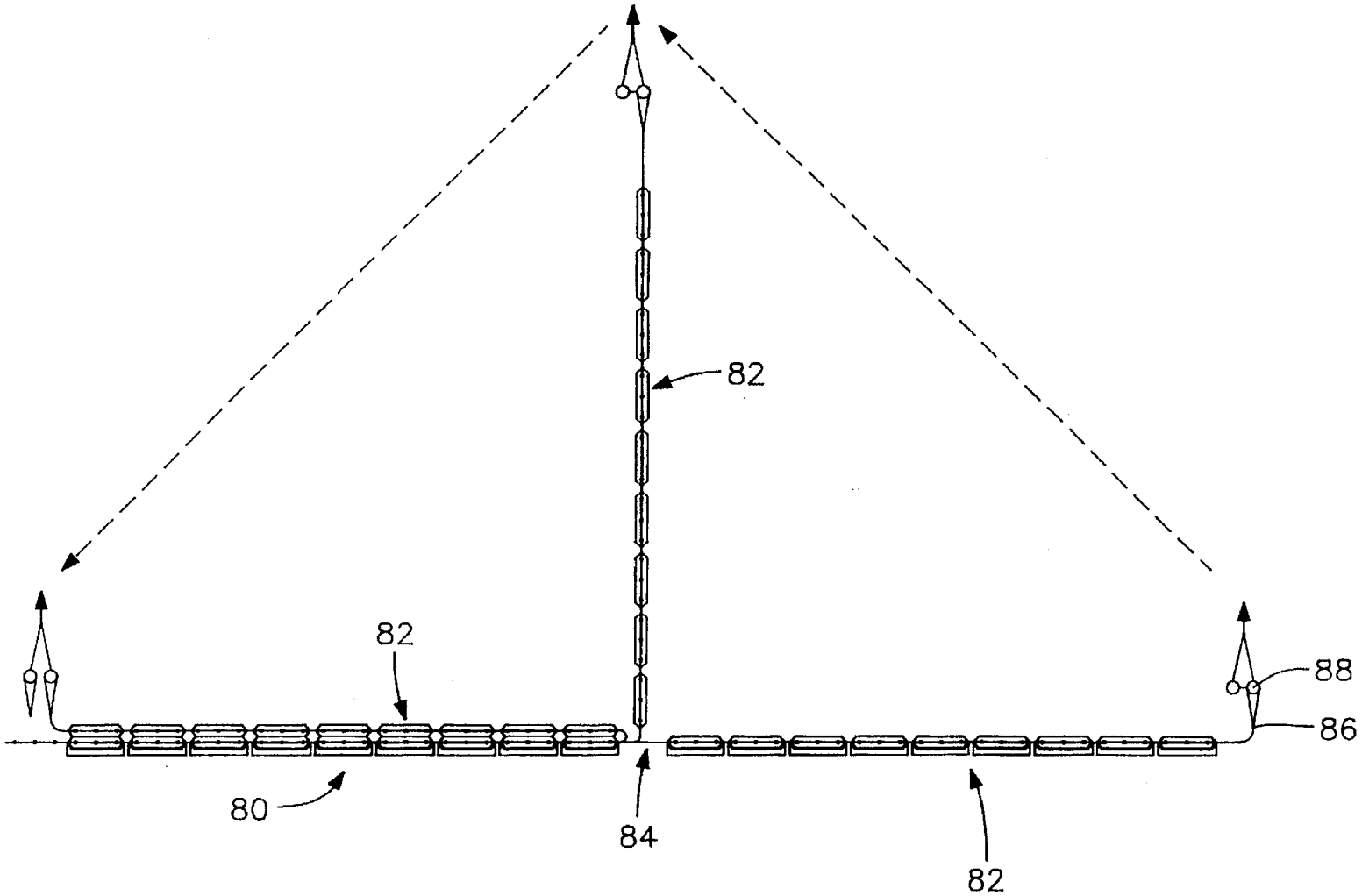
FIGS. 17 and 18 illustrate an alternate method of lifting a concrete geomattress according to this invention by a double lift sequence.
Figure 18:
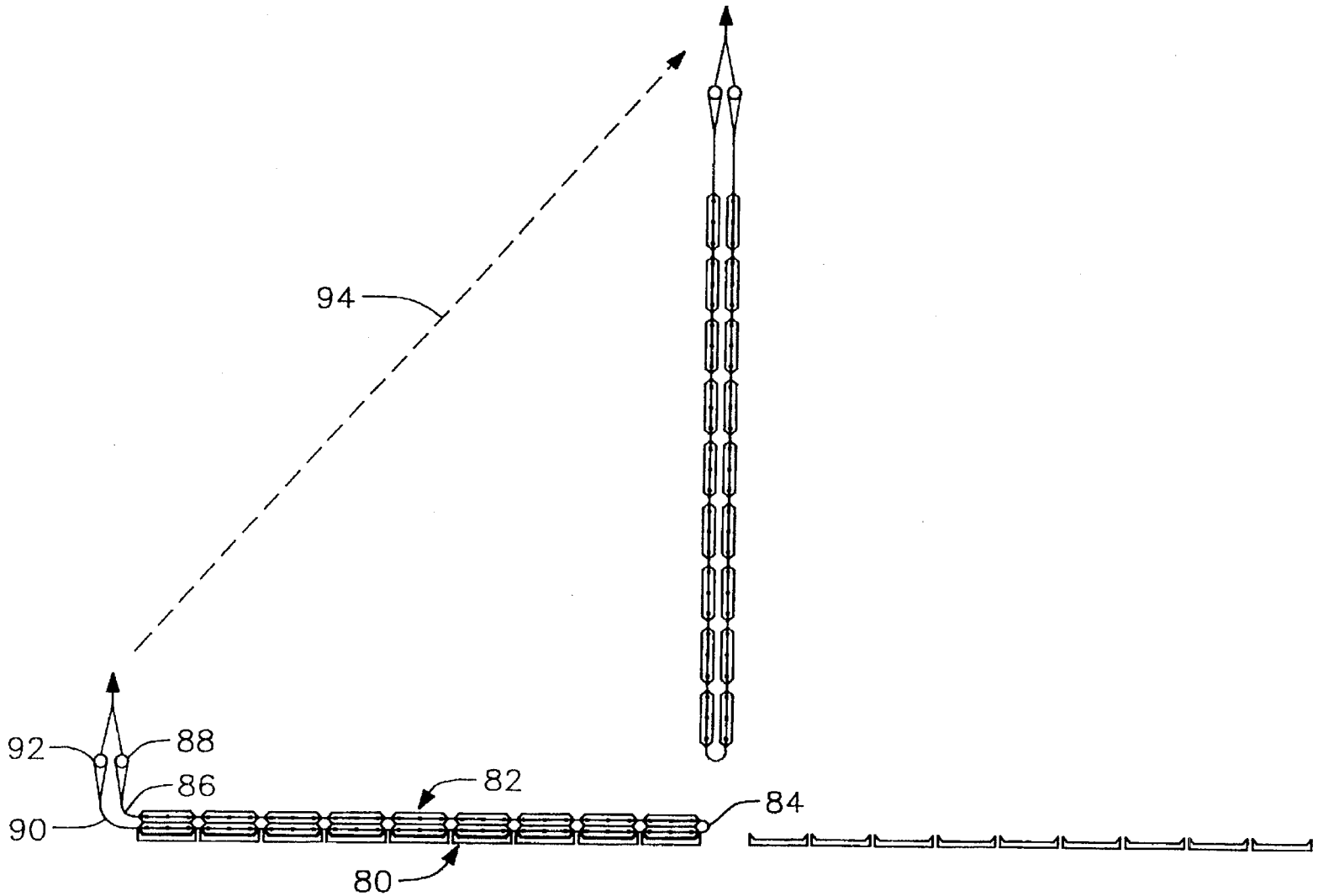

If an extended length of a geomattress is required, a geomattress having two separate sections as shown in FIGS. 17 and 18 may be formed according to the process illustrated in FIGS. 10 through 15. However, in a gap between two sections 80, 82 of the geomattress there is a length of geogrid material 84 joined between the two sections 80, 82, on the order, for example, of approximately 23 inches.

The geogrid section 82 is connected by terminal portion 86 of geogrid to a spreader bar 88 for lifting of the section 82 to a vertical orientation as shown in FIG. 17. Section 82 is then laid on top of section 80 as shown on the left side of FIG. 17. The terminal portion 90 of the geogrid extending from section 80 is connected to a spreader bar 92. The two terminal portions 86 and 90, connected to the spreader bars 88, 92, respectively, are then lifted by a crane or other suitable equipment in the direction of the arrow 94 to a vertical orientation as shown in the center of FIG. 18. The geomattress formed of two sections is then moved to a position of use or to a vehicle for transport.

At the site, the geomattress having two sections can be extended by reversing the process by which the geomattress sections 80, 82 were folded onto each other. The overall length achieved by the spreading out of the sections 80, 82 is greater than could be covered by a single length geomattress.

From the foregoing it will be recognized that the staggered arrangement of the concrete panels enables the formation of a continuous geomattress of virtually indefinite length and width, notwithstanding the limited width of the sheets of grid-like material, such as UX geogrid, resulting from the practical cross-machine dimensions of the commercial equipment available to manufacture such sheets. The machine direction length of such grid-like sheet materials, which are commonly manufactured in a continuous manner, has no bounds. With the offset concrete panels interconnecting juxtaposed lengths of sheet materials laterally, the only limitation on the overall dimensions of the geomattress of this invention is the strength of the portions of the sheet material spanning the gap between the concrete panels, and the ability of the lifting equipment to place the geomattress in position.

Having described the invention, many modifications thereto will become apparent to those skilled in the art to which it pertains without deviation from the spirit of the invention as defined by the scope of the appended claims.

I claim:

1. A concrete geomattress comprising:

at least one elongated sheet of material extending longitudinally of said geomattress, and a plurality of longitudinally spaced, transversely extending rows of concrete panels secured to said sheet of material with flexible portions of said sheet of material extending in the gaps defined between juxtaposed panels in at least some of said rows to enable the geomattress to be bent transversely along said flexible portions of said sheet of material, said sheet of material being a grid-like sheet of material of a uniaxially stretched polymer geogrid having a plurality of molecularly oriented elongated strands interconnected by transversely extending elements, said transversely extending elements being thickened bars, at least one bar being secured to each panel.

2. A concrete mattress according to claim 1, wherein terminal portions of said sheet of material extend laterally beyond the outermost concrete panels for engagement by a lifting means.

3. A concrete geomattress as claimed in claim 1, wherein a geotextile spans the openings of said grid-like sheet of material at least in the gaps defined between juxtaposed panels.

4. A concrete geomattress as claimed in claim 1, wherein said at least one bar is encased within the concrete of each said panel.

5. A concrete geomattress as claimed in claim 1, wherein the panels in adjacent rows of said geomattress are laterally staggered relative to each other.

6. A concrete geomattress according to claim 5, wherein adjacent rows of concrete panels are staggered by 50%.

7. A concrete geomattress as claimed in claim 1, further including at least two laterally spaced sections of longitudinally extending sheet material, the panels in adjacent rows of said geomattress are staggered, portions of each section of said sheet of material being secured to individual panels in adjacent rows.

8. A concrete geomattress as claimed in claim 7, wherein each section of said sheet material is a grid-like sheet of material.

9. A concrete geomattress as claimed in claim 8, wherein said grid-like sheet of material is a uniaxially stretched polymer geogrid having a plurality of molecularly oriented elongated strands interconnected by transversely extending elements.

10. A concrete geomattress as claimed in claim 9, wherein a geotextile spans the openings of said grid-like sheet of material at least in the gaps defined between juxtaposed panels.

11. A concrete geomattress as claimed in claim 8, wherein said transversely extending elements are thickened bars, at least one bar being secured to each panel.

12. A concrete geomattress as claimed in claim 11, wherein said at least one bar is encased within the concrete of each said panel.

13. A concrete mattress according to claim 1, wherein peripheral sidewalls of said concrete panels are tapered to facilitate bending between adjacent rows of concrete panels.

14. A capped dredge disposal site comprising:

a mound of dredge disposal material located underwater, a plurality of geomattresses located on top of said mound to substantially cover said mound, each of said plurality of geomattresses including at least one elongated sheet of material extending longitudinally of said geomattress, and a plurality of longitudinally spaced, transversely extending rows of concrete panels secured to said sheet of material with flexible portions of said sheet of material extending in the gaps defined between juxtaposed panels in at least some of said rows to enable the geomattress to be bent transversely along said flexible portions of said sheet of material, said sheet of material being a grid-like sheet of material of a uniaxially stretched polymer geogrid having a plurality of molecularly oriented elongated strands interconnected by transversely extending elements, said transversely extending elements being thickened bars, at least one bar being secured to each panel.

15. A capped dredge disposal site according to claim 14, wherein terminal portions of said sheet of material extend laterally beyond the outermost concrete panels for engagement by a lifting means.

16. A capped dredge disposal site as claimed in claim 14, wherein a geotextile spans the openings of said grid-like sheet of material at least in the gaps defined between juxtaposed panels.

17. A capped dredge disposal site as claimed in claim 14, wherein said at least one bar is encased within the concrete of each said panel.

18. A capped dredge disposal site as claimed in claim 14, wherein the panels in adjacent rows of said geomattress are laterally staggered relative to each other.

19. A capped dredge disposal site according to claim 18, wherein adjacent rows of concrete panels are staggered by 50%.

20. A capped dredge disposal site as claimed in claim 14, further including at least two laterally spaced sections of longitudinally extending sheet material, the panels in adjacent rows of said geomattress are staggered, portions of each section of said sheet of material being secured to individual panels in adjacent rows.

21. A capped dredge disposal site according to claim 14, wherein peripheral sidewalls of said concrete panels are tapered to facilitate bending between adjacent rows of concrete panels.

22. A concrete geomattress comprising:

an elongated sheet of material extending longitudinally of said geomattress, and a plurality of longitudinally spaced, transversely extending rows of concrete panels secured to said sheet of material with flexible portions of said sheet of material extending in the gaps defined between juxtaposed panels in at least some of said rows to enable the geomattress to be bent transversely along said flexible portions of said sheet of material, at least two laterally spaced sections of said elongated sheet of material, the panels in adjacent rows of said geomattress being staggered, individual panels being secured to adjacent sections of said sheet of material, each section of said sheet material being a grid-like sheet of material of a uniaxially stretched polymer geogrid having a plurality of molecularly oriented elongated strands interconnected by transversely extending elements, and said transversely extending elements being thickened bars, at least one bar being secured to each panel.

23. A concrete mattress according to claim 21, wherein terminal portions of said sheet of material extend laterally beyond the outermost concrete panels for engagement by a lifting means.

24. A concrete geomattress as claimed in claim 22, wherein a geotextile spans the openings of said grid-like sheet of material at least in the gaps defined between juxtaposed panels.

25. A concrete geomattress as claimed in claim 22, wherein said at least one bar is encased within the concrete of each said panel.

26. A concrete geomattress as claimed in claim 22, wherein the panels in adjacent rows of said geomattress are laterally staggered relative to each other.

27. A concrete geomattress according to claim 26, wherein adjacent rows of concrete panels are staggered by 50%.

28. A concrete mattress according to claim 22, wherein peripheral sidewalls of said concrete panels are tapered to facilitate bending between adjacent rows of concrete panels.

29. A capped dredge disposal site comprising:

a mound of dredge disposal material located underwater, a plurality of geomattresses located on top of said mound to substantially cover said mound, each of said plurality of geomattresses including an elongated sheet of material extending longitudinally of said geomattress, and a plurality of longitudinally spaced, transversely extending rows of concrete panels secured to said sheet of material with flexible portions of said sheet of material extending in the gaps defined between juxtaposed panels in at least some of said rows to enable the geomattress to be bent transversely along said flexible portions of said sheet of material, at least two laterally spaced sections of said elongated sheet of material, the panels in adjacent rows of said geomattress being staggered, individual panels being secured to adjacent sections of said sheet of material, each section of said sheet material being a grid-like sheet of material of a uniaxially stretched polymer geogrid having a plurality of molecularly oriented elongated strands interconnected by transversely extending elements, and said transversely extending elements being thickened bars, at least one bar being secured to each panel.

30. A capped dredge disposal site according to claim 29, wherein terminal portions of said sheet of material extend laterally beyond the outermost concrete panels for engagement by a lifting means.

31. A capped dredge disposal site as claimed in claim 29, wherein a geotextile spans the openings of said grid-like sheet of material at least in the gaps defined between juxtaposed panels.

32. A capped dredge disposal site as claimed in claim 29, wherein said at least one bar is encased within the concrete of each said panel.

33. A capped dredge disposal site as claimed in claim 29, wherein the panels in adjacent rows of said geomattress are laterally staggered relative to each other.

34. A capped dredge disposal site according to claim 33, wherein adjacent rows of concrete panels are staggered by 50%.

35. A capped dredge disposal site according to claim 29, wherein peripheral sidewalls of said concrete panels are tapered to facilitate bending between adjacent rows of concrete panels.

* * * * *